US010920341B2

(12) United States Patent
Uchida et al.

(10) Patent No.: US 10,920,341 B2
(45) Date of Patent: Feb. 16, 2021

(54) ELECTROSPINNING APPARATUS

(71) Applicant: Kabushiki Kaisha Toshiba, Minato-ku (JP)

(72) Inventors: Kenya Uchida, Yokohama (JP); Ikuo Uematsu, Yokohama (JP); Tomomichi Naka, Kashiwazaki (JP); Yoko Tokuno, Ota (JP); Yuma Kikuchi, Kashiwazaki (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 320 days.

(21) Appl. No.: 15/919,503

(22) Filed: Mar. 13, 2018

(65) Prior Publication Data

US 2018/0202074 A1 Jul. 19, 2018

Related U.S. Application Data

(63) Continuation of application No. PCT/JP2017/032478, filed on Sep. 8, 2017.

(30) Foreign Application Priority Data

Nov. 14, 2016 (JP) ..... JP2016-221299

(51) Int. Cl.
*D01D 5/00* (2006.01)
*D01D 4/04* (2006.01)
(Continued)

(52) U.S. Cl.
CPC ..... *D01D 5/0069* (2013.01); *D01D 4/04* (2013.01); *D01D 5/0076* (2013.01);
(Continued)

(58) Field of Classification Search
CPC ..... D01D 5/0069; D04H 1/728
See application file for complete search history.

(56) References Cited

U.S. PATENT DOCUMENTS 2,158,416 A 5/1939 Formhals
8,778,380 B2 7/2014 Kim et al.
(Continued)

FOREIGN PATENT DOCUMENTS

EP 3 040 462 A1 7/2016
JP 09-157938 6/1997
(Continued)

OTHER PUBLICATIONS

International Search Report dated Nov. 21, 2017 in PCT/JP2017/032478 filed Sep. 8, 2017 (with English Translation of Categories of Cited Documents).
(Continued)

*Primary Examiner* — Jacob T Minskey
*Assistant Examiner* — Adrien J Bernard
(74) *Attorney, Agent, or Firm* — Oblon, McClelland, Maier & Neustadt, L.L.P.

(57) ABSTRACT

An electrospinning apparatus according to an embodiment is configured to deposit a fiber on a collector or a member. The electrospinning apparatus includes a first nozzle head provided on one side of the collector or the member, and a second nozzle head provided on the side opposite to the first nozzle head with the collector or the member interposed. The first nozzle head and the second nozzle head are at a section where the collector or the member moves in a direction tilted with respect to a horizontal direction.

10 Claims, 7 Drawing Sheets

(51) Int. Cl.
*D04H 1/728* (2012.01)
*D04H 1/55* (2012.01)
*D04H 1/4242* (2012.01)

(52) U.S. Cl.
CPC ..... *D04H 1/728* (2013.01); *D01D 5/0038* (2013.01); *D04H 1/4242* (2013.01); *D04H 1/55* (2013.01)

(56) References Cited

U.S. PATENT DOCUMENTS

| | | | | |
|---|---|---|---|---|
| 2004/0080083 | A1 | 4/2004 | Czado | |
| 2008/0085387 | A1 | 4/2008 | Aoyama et al. | |
| 2010/0330419 | A1 | 12/2010 | Cui et al. | |
| 2012/0064225 | A1 | 3/2012 | Bachrach et al. | |
| 2012/0141656 | A1* | 6/2012 | Orr ..... | D01D 5/0061 427/2.25 |
| 2016/0047075 | A1 | 2/2016 | Foley et al. | |

FOREIGN PATENT DOCUMENTS

| | | | |
|---|---|---|---|
| JP | 2007-092213 | | 4/2007 |
| JP | 2008-078476 | | 4/2008 |
| JP | 2008-231623 | | 10/2008 |
| JP | 2008-231634 | | 10/2008 |
| JP | 2010-031426 | | 2/2010 |
| JP | 2012-164584 | A | 8/2012 |
| JP | 2013-542555 | | 11/2013 |
| JP | 2013-251078 | | 12/2013 |
| KR | 10-2004-0108525 | A | 12/2004 |
| KR | 10-0702864 | | 4/2007 |
| KR | 10-1466286 | B1 | 12/2014 |
| KR | 10-1635031 | B1 | 7/2016 |

OTHER PUBLICATIONS

Written Opinion dated Nov. 21, 2017 in PCT/JP2017/032478 filed Sep. 8, 2017.

* cited by examiner

ELECTROSPINNING APPARATUS

CROSS-REFERENCE TO RELATED APPLICATIONS

This application is based upon and claims the benefit of priority from Japanese Patent Application No. 2016-221299, filed on Nov. 14, 2016, and the PCT Patent Application PCT/JP2017/032478, filed on Sep. 8, 2017; the entire contents of which are incorporated herein by reference.

FIELD

An embodiment of the invention relates to an electrospinning apparatus.

BACKGROUND

There is an electrospinning apparatus that deposits a fine fiber on the surface of a member by electrospinning (also called electric field spinning, charge-induced spinning, etc.).

A nozzle head that includes multiple nozzles discharging a source material liquid is provided in the electrospinning apparatus. Also, an electrospinning apparatus including a nozzle head and a member having a band configuration has been proposed. The member and the nozzle head are provided to oppose each other. In the electrospinning apparatus that includes the member having the band configuration, the fiber is deposited on the surface of the member having the band configuration while moving the member having the band configuration. Thus, a deposited body that includes the fiber can be produced continuously; therefore, the productivity of the deposited body can be increased.

In such a case, the production amount of the deposited body per unit time or per unit surface area can be increased by increasing the number of nozzle heads. However, if the number of nozzle heads is simply increased, this may cause an enlargement of the electrospinning apparatus.

Therefore, it has been desirable to develop an electrospinning apparatus in which improvement of the productivity and better space conservation can be realized.

DETAILED DESCRIPTION

Figure 1:
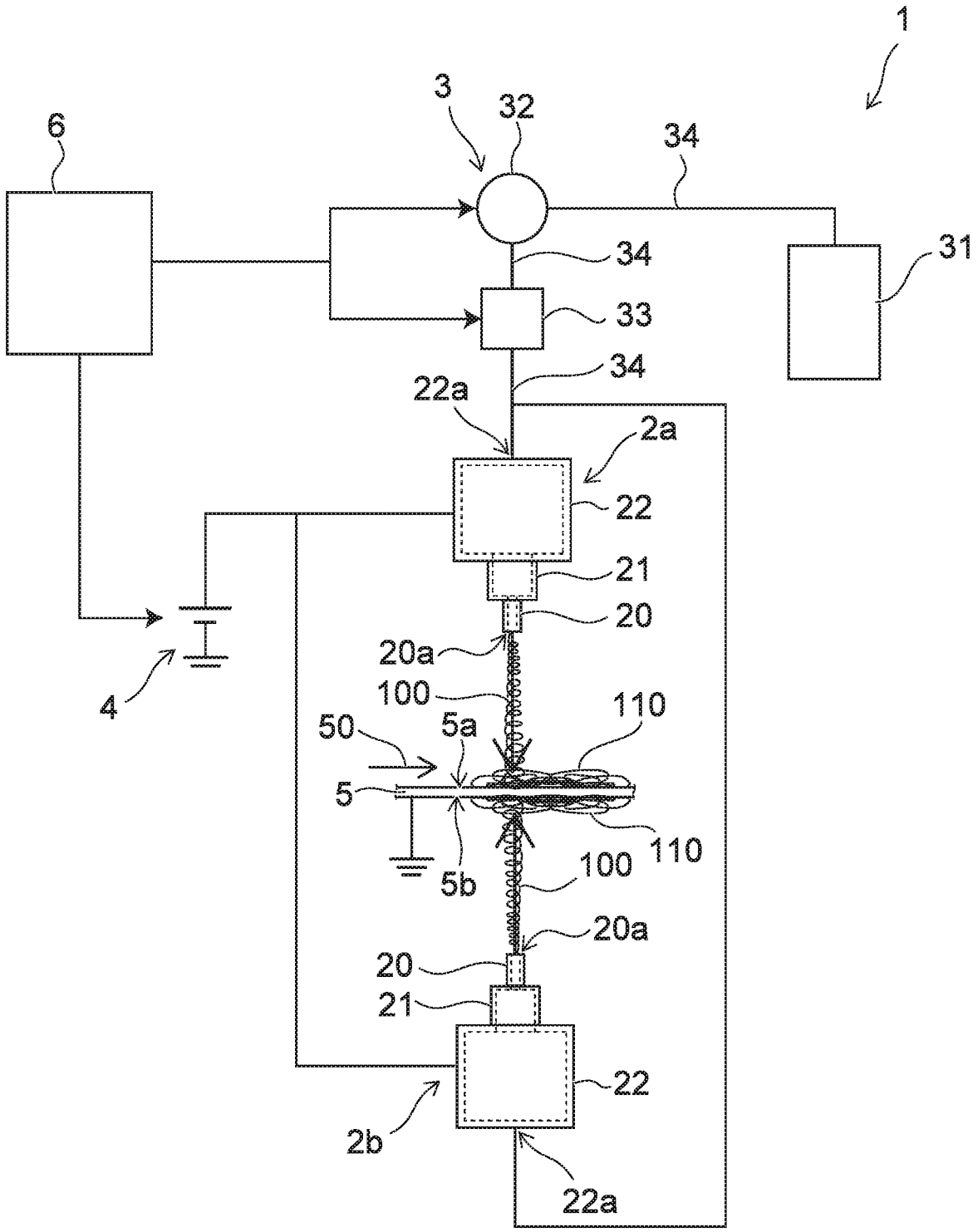
FIG. 1 is a schematic view for illustrating an electrospinning apparatus according to a first embodiment.

An electrospinning apparatus according to an embodiment is configured to deposit a fiber on a collector or a member. The electrospinning apparatus includes a first nozzle head provided on one side of the collector or the member, and a second nozzle head provided on the side opposite to the first nozzle head with the collector or the member interposed. The first nozzle head and the second nozzle head are at a section where the collector or the member moves in a direction tilted with respect to a horizontal direction.

Embodiments will now be illustrated with reference to the drawings. Similar components in the drawings are marked with the same reference numerals; and a detailed description is omitted as appropriate.

An electrospinning apparatus 1 that includes a so-called needle-type nozzle head will now be illustrated as an example. However, the configuration of the nozzle provided in the nozzle head is not limited to a needle-like configuration.

For example, the nozzle that is provided in the nozzle head may be a nozzle having a circular conic configuration, etc. In such a case, if a nozzle having a needle-like configuration is used, electric field concentration occurs easily at the vicinity of the outlet of the nozzle; therefore, the strength of the electric field generated between the nozzle and the collector becomes high. On the other hand, if a nozzle having a circular conic configuration is used, the mechanical strength of the nozzle can be increased. Also, because the tip of the nozzle having the circular conic configuration can be sharp, the strength of the electric field generated between the nozzle and the collector becomes high similarly to the nozzle having the needle-like configuration.

Further, the nozzle head may be a so-called blade-type nozzle head, etc. If a blade-type nozzle head is used, the mechanical strength can be increased; therefore, damage of the nozzle head when cleaning, etc., can be suppressed. Also, the cleaning of the nozzle head is easy. The configuration of the blade-type nozzle head is not particularly limited and may be, for example, a rectangular parallelepiped configuration or a circular arc-like configuration.

FIG. 1 is a schematic view for illustrating the electrospinning apparatus 1 according to a first embodiment.

As shown in FIG. 1, a first nozzle head 2*a*, a second nozzle head 2*b*, a source material liquid supplier 3, a power supply 4, a collector 5, and a controller 6 are provided in the electrospinning apparatus 1.

The first nozzle head 2*a* is provided on one side of the collector 5. For example, the first nozzle head 2*a* is provided above the collector 5. The first nozzle head 2*a* opposes a first surface 5*a* of the collector 5.

The second nozzle head 2*b* is provided on the side opposite to the first nozzle head 2*a* with the collector 5 interposed. For example, the second nozzle head 2*b* is provided below the collector 5. The second nozzle head 2*b* opposes a second surface 5*b* of the collector 5 on the side opposite to the first surface 5*a*.

In the case of the components illustrated in FIG. 1, the second nozzle head 2*b* opposes the first nozzle head 2*a* with the collector 5 interposed. In other words, when viewed in plan, the second nozzle head 2*b* is provided at a position overlapping the first nozzle head 2*a*.

The first nozzle head 2*a* and the second nozzle head 2*b* include nozzles 20, connectors 21, and main parts 22.

The nozzle 20 has a needle-like configuration. A hole for discharging the source material liquid is provided in the interior of the nozzle 20. The hole for discharging the source material liquid communicates between the end portion of the nozzle 20 on the connector 21 side and the end portion (the tip) of the nozzle 20 on the collector 5 side. The opening of the hole for discharging the source material liquid on the collector 5 side is an outlet 20*a*.

Although the outer diameter dimension (in the case where the nozzle 20 has a cylindrical configuration, the diametrical dimension) of the nozzle 20 is not particularly limited, it is favorable for the outer diameter dimension to be small. If the outer diameter dimension is set to be small, electric field concentration occurs easily at the vicinity of the outlet 20*a* of the nozzle 20. If the electric field concentration occurs at the vicinity of the outlet 20*a* of the nozzle 20, the strength of the electric field generated between the nozzle 20 and the collector 5 can be increased compared to the case where the outer diameter dimension of the nozzle 20 is large. Therefore, the voltage that is applied by the power supply 5 can be set to be low compared to the case where the outer diameter dimension of the nozzle 20 is large. In other words, the drive voltage can be reduced compared to the case where the outer diameter dimension of the nozzle 20 is large. In such a case, for example, the outer diameter dimension of the nozzle 20 can be set to about 0.3 mm to 1.3 mm.

The dimension (in the case where the outlet 20*a* is a circle, the diametrical dimension) of the outlet 20*a* is not particularly limited. The dimension of the outlet 20*a* can be modified appropriately according to the cross-sectional dimension of a fiber 100 to be formed. For example, the dimension of the outlet 20*a* (the inner diameter dimension of the nozzle 20) can be set to about 0.1 mm to 1 mm.

The nozzle 20 is formed from a conductive material. It is favorable for the material of the nozzle 20 to be conductive and to have resistance to the source material liquid described below. For example, the nozzle 20 can be formed from stainless steel, etc.

The number of the nozzles 20 is not particularly limited and can be modified appropriately according to the size of the collector 5, etc. It is sufficient for at least one nozzle 20 to be provided.

In the case where multiple nozzles 20 are provided, the multiple nozzles 20 are provided to be arranged at a prescribed spacing. For example, the multiple nozzles 20 can be provided to be arranged in a direction orthogonal to a movement direction 50 of the collector 5. Also, the arrangement form of the multiple nozzles 20 is not particularly limited. For example, the multiple nozzles 20 also can be provided to be arranged in one column, can be provided to be arranged in multiple columns, can be provided to be arranged on a circumference or on concentric circles, or can be provided to be arranged in a staggered configuration or a matrix configuration.

The connector 21 is provided between the nozzle 20 and the main part 22. A hole for supplying the source material liquid from the main part 22 to the nozzle 20 is provided in the interior of the connector 21. The hole that is provided in the interior of the connector 21 communicates with the hole provided in the interior of the nozzle 20 and the space provided in the interior of the main part 22.

The connector 21 is formed from a conductive material. It is favorable for the material of the connector 21 to be conductive and to have resistance to the source material liquid. For example, the connector 21 can be formed from stainless steel, etc.

In the case where the voltage is directly applied to the nozzle 20, it is not always necessary for the connector 21 to be formed from a conductive material.

The connector 21 is not always necessary; and the nozzle 20 may be provided directly at the main part 22.

However, there are cases where the source material liquid that is discharged adheres to the end portion of the nozzle 20 on the outlet 20*a* side and to the vicinity of the end portion. Therefore, it is favorable to perform, as necessary or regularly, cleaning of the end portion of the nozzle 20 on the outlet 20*a* side and the vicinity of the end portion.

In such a case, the end portion of the nozzle 20 on the connector 21 side can be fixed to the connector 21; and the connector 21 can be provided detachably at the main part 22. For example, an external-thread screw can be provided in the end portion of the connector 21 on the main part 22 side; and an internal-thread tap can be provided in the side surface of the main part 22. Also, the connector 21 can be provided detachably at the main part 22 by using a luer taper (luer taper) (also called a luer adapter, a luer lock, a luer connector, a luer fit, etc.). For example, a female luer (female luer) can be provided on the main part 22 side of the connector 21; and a male luer (male luer) can be provided on the side surface of the main part 22. In other words, the connector 21 may be connected to the main part 22 by using a screw or a luer taper.

A space in which the source material liquid is stored is provided in the interior of the main part 22. Although the configuration of the main part 22 is not particularly limited, the main part 22 can have a rod configuration in the case where the multiple nozzles 20 are provided. For example, the main part 22 that has the rod configuration can extend in a direction orthogonal to the movement direction 50 of the collector 5. The main part 22 that has the rod configuration can be provided to be parallel to the first surface 5*a* or the second surface 5*b* of the collector 5.

Also, a supply port 22*a* is provided in the main part 22. The source material liquid that is supplied from the source material liquid supplier 3 is introduced to the interior of the main part 22 via the supply port 22*a*. The number and the arrangement positions of the supply ports 22*a* are not particularly limited. For example, the supply port 22*a* can be provided on the side opposite to the side where the nozzle 20 of the main part 22 is provided.

It is favorable for the material of the main part 22 to be conductive and to have resistance to the source material liquid. For example, the main part 22 can be formed from stainless steel, etc.

The source material liquid supplier 3 includes a container 31, a supplier 32, a source material liquid controller 33, and a pipe 34.

The container 31 stores the source material liquid. The container 31 is formed from a material having resistance to the source material liquid. For example, the container 31 can be formed from stainless steel, etc.

The source material liquid is a polymeric substance dissolved in a solvent.

The polymeric substance is not particularly limited and can be modified appropriately according to the material properties of the fiber 100 to be formed. The polymeric substance can be, for example, polypropylene, polyethylene, polystyrene, polyethylene terephthalate, polyvinyl chloride, polycarbonate, nylon, aramid, etc.

It is sufficient for the solvent to be able to dissolve the polymeric substance. The solvent can be modified appropriately according to the polymeric substance to be dissolved. The solvent can be, for example, methanol, ethanol, isopropyl alcohol, acetone, benzene, toluene, etc.

The polymeric substance and the solvent are not limited to those illustrated.

Also, the source material liquid can be produced from a solvent and one type of polymeric substance, or can be produced by mixing a solvent and multiple types of polymeric substances.

Also, the source material liquid that is supplied to the first nozzle head 2*a* and the source material liquid that is supplied to the second nozzle head 2*b* may be of the same type; or the source material liquid that is supplied to the first nozzle head 2*a* and the source material liquid that is supplied to the second nozzle head 2*b* may be of different types.

The source material liquid is caused to collect at the vicinity of the outlet 20*a* by surface tension. To this end, the viscosity of the source material liquid can be modified appropriately according to the dimension of the outlet 20*a*, etc. The viscosity of the source material liquid can be determined by performing experiments and/or simulations. Also, the viscosity of the source material liquid can be controlled by the mixture proportion of the solvent and the polymeric substance.

The supplier 32 supplies the source material liquid stored in the container 31 to the main part 22. The supplier 32 can be, for example, a pump having resistance to the source material liquid, etc. Also, for example, the supplier 32 may feed the source material liquid stored in the container 31 by supplying a gas to the container 31.

The source material liquid controller 33 controls the flow rate, the pressure, etc., of the source material liquid supplied to the main part 22 so that the source material liquid in the interior of the main part 22 is not pushed out from the outlet 20*a* when new source material liquid is supplied to the interior of the main part 22. In other words, the source material liquid is caused to collect at the vicinity of the outlet 20*a* by the surface tension. The control amount for the source material liquid controller 33 can be modified appropriately by the dimension of the outlet 20*a*, the viscosity of the source material liquid, etc. The control amount for the source material liquid controller 33 can be determined by performing experiments and/or simulations.

Also, the source material liquid controller 33 can be able to switch between the starting of the supply and the stopping of the supply of the source material liquid.

The supplier 32 and the source material liquid controller 33 are not always necessary. For example, if the container 31 is provided at a position that is higher than the position of the main part 22, the source material liquid can be supplied to the main part 22 by utilizing gravity. Then, the source material liquid that is in the interior of the main part 22 can be caused not to be pushed out from the outlet 20*a* when the new source material liquid is supplied to the interior of the main part 22 by appropriately setting the height position of the container 31. In such a case, the height position of the container 31 can be modified appropriately using the dimension of the outlet 20*a*, the viscosity of the source material liquid, etc. The height position of the container 31 can be determined by performing experiments and/or simulations.

The pipe 34 is provided between the container 31 and the supplier 32, between the supplier 32 and the source material liquid controller 33, and between the source material liquid controller 33 and the main part 22. The pipe 34 is used as a flow channel of the source material liquid. The pipe 34 is formed from a material having resistance to the source material liquid.

The power supply 4 applies the voltage to the nozzle 20 via the main part 22 and the connector 21. Not-illustrated terminals that are electrically connected to the nozzle 20 may be provided. In such a case, the power supply 4 applies the voltage to the nozzle 20 via the not-illustrated terminals. In other words, it is sufficient for the voltage to be able to be applied to the nozzle 20 from the power supply 4.

The polarity of the voltage (the drive voltage) applied to the nozzle 20 can be set to be positive or set to be negative. However, if a negative voltage is applied to the nozzle 20, irregular electric discharge occurs easily because electrons are discharged from the tip of the nozzle 20. Therefore, as shown in FIG. 1, it is favorable for the polarity of the voltage applied to the nozzle 20 to be positive.

The voltage that is applied to the nozzle 20 can be modified appropriately according to the type of the polymeric substance included in the source material liquid, the distance between the nozzle 20 and the collector 5, etc. For example, the power supply 4 can apply a voltage to the nozzle 20 so that the potential difference between the nozzle 20 and the collector 5 is 10 kV or more. In such a case, if a blade-type nozzle head is used, the voltage that is applied to the nozzle is about 70 kV. On the other hand, if a needle-type nozzle head such as that illustrated in FIG. 1 is used, the voltage that is applied to the nozzle 20 can be set to 50 kV or less. Therefore, a reduction of the drive voltage can be realized.

The power supply 4 can be, for example, a direct current-high voltage power supply. For example, the power supply 4 can output a direct current voltage of not less than 10 kV and not more than 100 kV.

The electrospinning apparatus 1 illustrated in FIG. 1 supplies the source material liquid to the first nozzle head 2*a* and the second nozzle head 2*b* by one source material liquid supplier 3 and applies the voltage to the first nozzle head 2*a* and the second nozzle head 2*b* by one power supply 4. Thus, simplification of the configuration, better space conservation, a reduction of the manufacturing cost, etc., of the electrospinning apparatus 1 can be realized.

On the other hand, one each of the source material liquid supplier 3 and the power supply 4 can be provided respectively for the first nozzle head 2*a* and the second nozzle head 2*b*. Thus, the control of the supply amount of the source material liquid and/or the control of the applied voltage can be performed respectively for the first nozzle head 2*a* and the second nozzle head 2*b*. Therefore, the deposition amount of the fiber 100 at the first surface 5*a* of the collector 5 and the deposition amount of the fiber 100 at the second surface 5*b* of the collector 5 can be changed. For example, it is possible to simultaneously form deposited bodies 110 having different thicknesses.

The collector 5 is provided on the side of the nozzle 20 where the source material liquid is discharged. The collector 5 is grounded. A voltage of the reverse polarity of the voltage applied to the nozzle 20 may be applied to the collector 5. The collector 5 can be formed from a conductive material. It is favorable for the material of the collector 5 to be conductive and to have resistance to the source material liquid. The material of the collector 5 can be, for example, stainless steel, etc.

The collector 5 moves in a prescribed direction. The collector 5 illustrated in FIG. 1 has a band configuration. For example, one end portion of the collector 5 can be provided at a not-illustrated first roller; and another end portion of the collector 5 can be provided at a not-illustrated second roller. Then, drive mechanisms such as motors, etc., can be connected to the first roller and the second roller; and the collector 5 can be caused to move back and forth between the first roller and the second roller.

Also, the collector 5 may be, for example, a plate-like body moved in the prescribed direction by an industrial robot, etc.

Also, the collector 5 may be, for example, a drum rotating in the prescribed direction.

Also, the collector 5 may be caused to circulate between a roller 51 and a roller 52 as a belt of a belt conveyor.

Figure 2A:
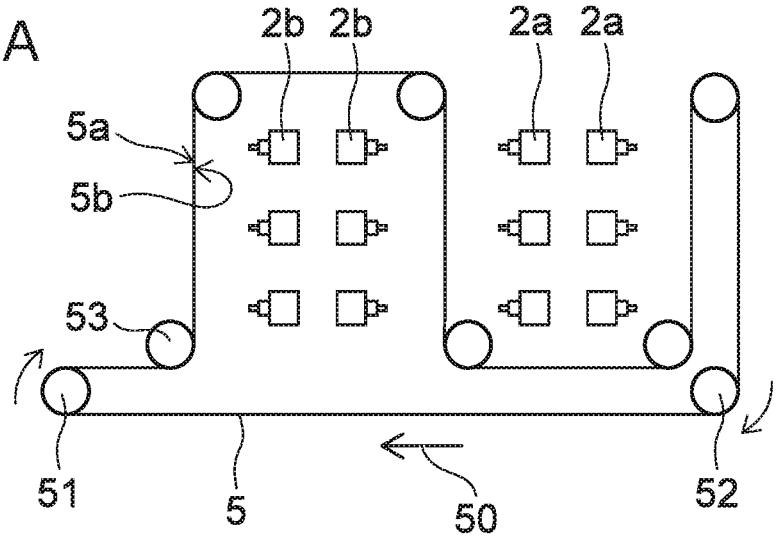
FIGS. 2A to 2C are schematic views for illustrating circulating collectors.
Figure 2B:
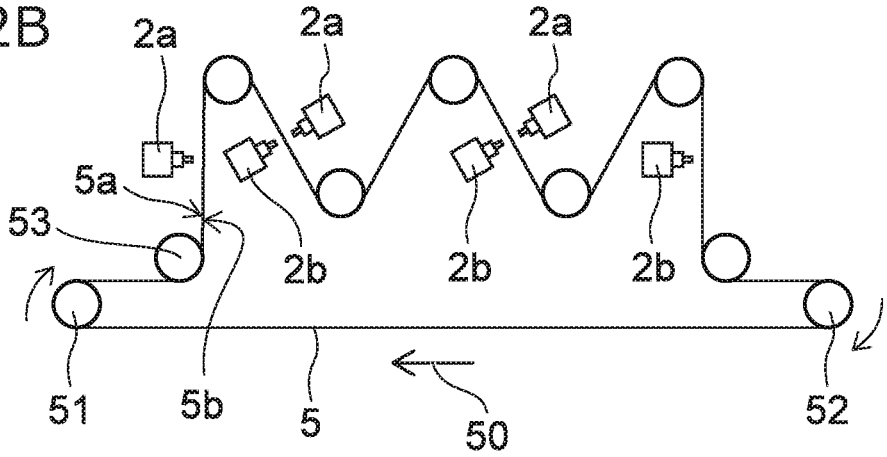
Figure 2C:
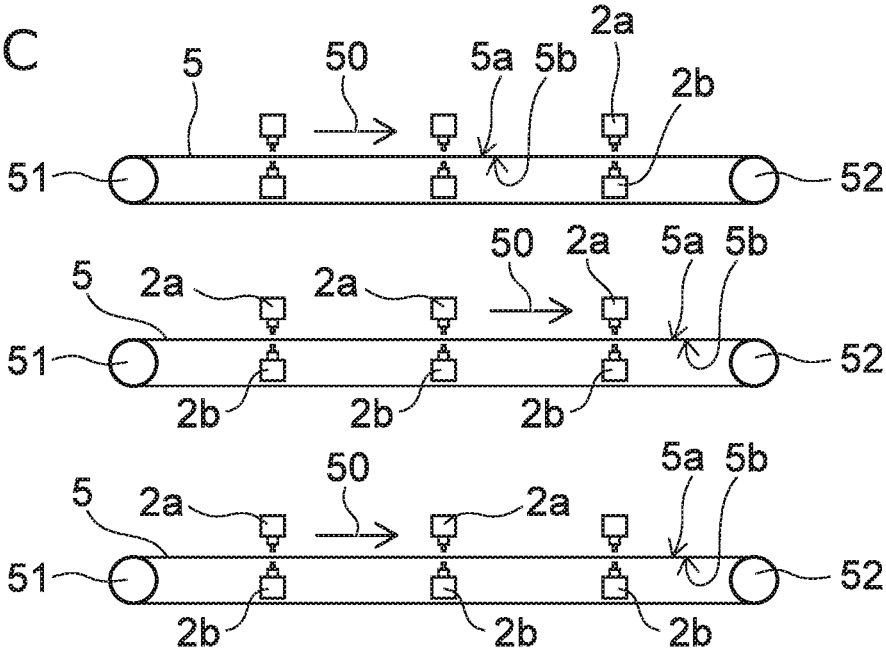

FIGS. 2A to 2C are schematic views for illustrating the circulating collector 5.

As shown in FIGS. 2A to 2C, the collector 5 can be caused to circulate between the roller 51 and the roller 52 by providing the roller 51 and the roller 52 which are drive rollers, and a roller 53 which is a guide roller. In such a case, the roller 53 can be multiply provided; and the movement direction of the collector 5 can be modified arbitrarily by appropriately modifying the arrangement of the multiple rollers 53. For example, as shown in FIG. 2A, the collector 5 can be moved in the horizontal direction and the vertical direction. As shown in FIG. 2B, the collector 5 can be moved in a direction tilted with respect to the horizontal direction.

Also, the circulating collector 5 can be multiply provided. In such a case, the multiple collectors 5 can be provided to be arranged in the horizontal direction and can be provided to be arranged in the vertical direction as shown in FIG. 2C.

Also, the collector 5 may be fed in one direction.

Figure 3A:
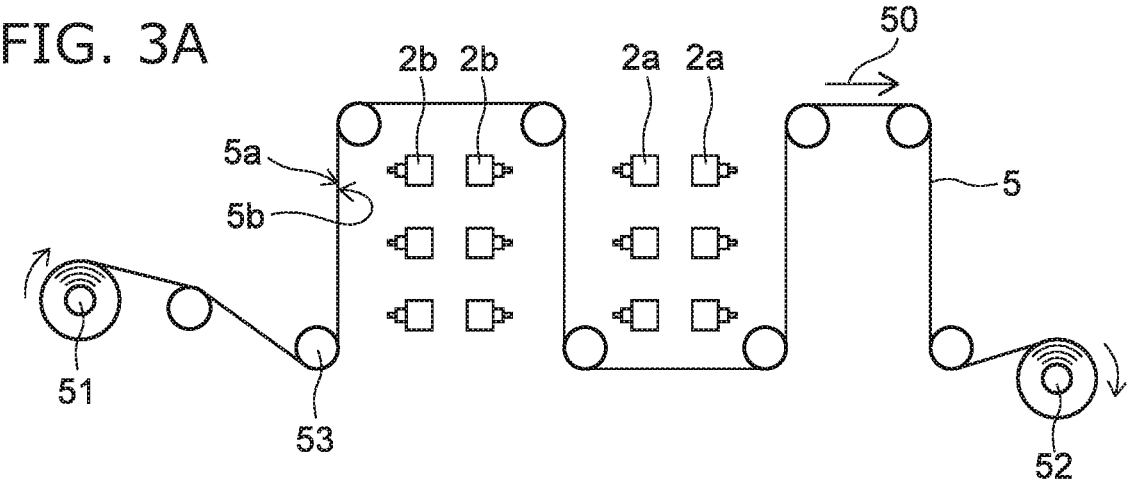
FIGS. 3A to 3C are schematic views for illustrating collectors fed in one direction.
Figure 3B:
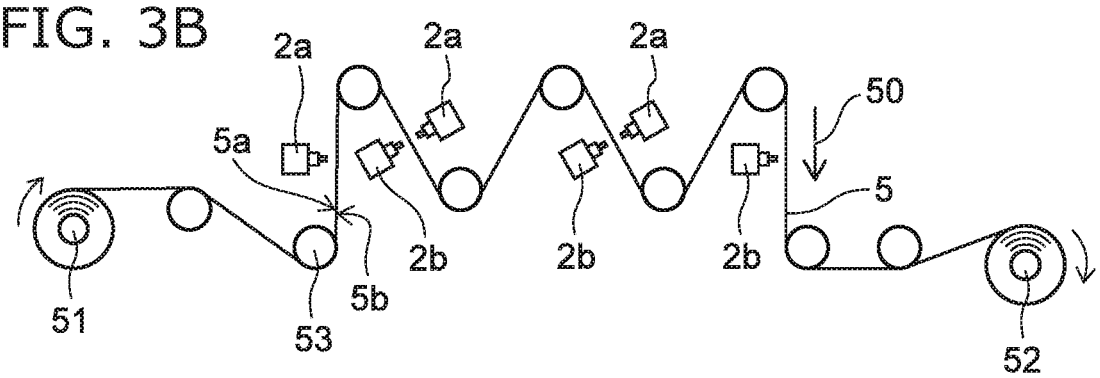
Figure 3C:
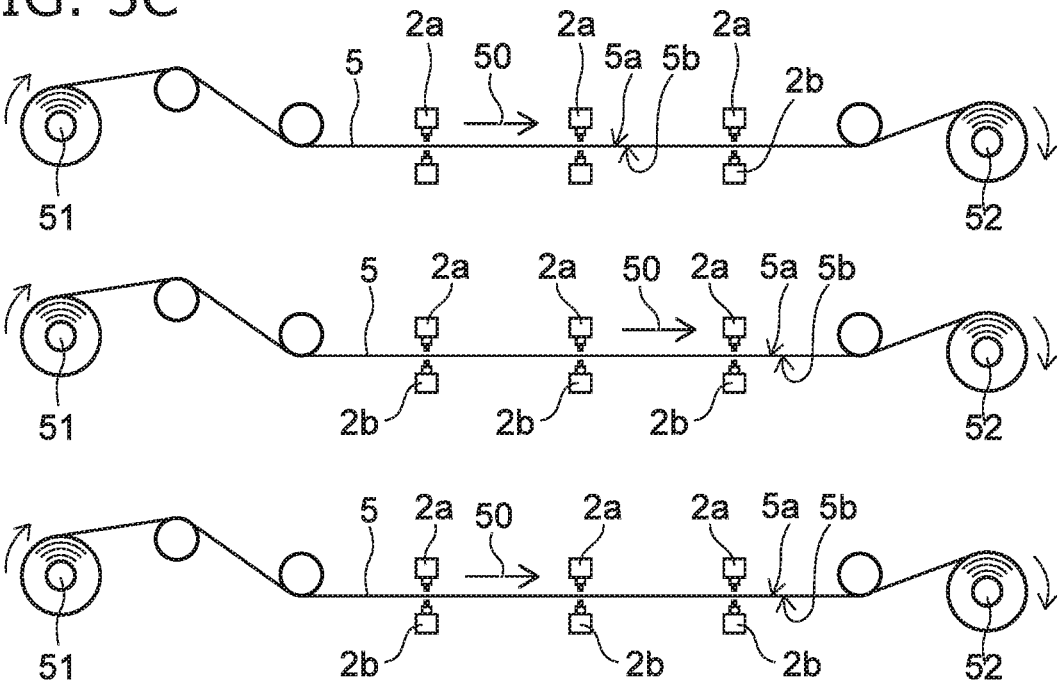

FIGS. 3A to 3C are schematic views for illustrating the collector 5 fed in one direction. As shown in FIGS. 3A to 3C, the collector 5 can be fed from the roller 51 to the roller 52 by providing the roller 51 and the roller 52 which are drive rollers and the roller 53 which is a guide roller. In such a case, the roller 53 can be multiply provided; and the movement direction of the collector 5 can be modified arbitrarily by appropriately modifying the arrangement of the multiple rollers 53. For example, as shown in FIG. 3A, the collector 5 can be moved in the horizontal direction and the vertical direction. As shown in FIG. 3B, the collector 5 can be moved in a direction tilted with respect to the horizontal direction.

Also, the collector 5 that is fed from the roller 51 to the roller 52 can be multiply provided. In such a case, the multiple collectors 5 can be provided to be arranged in the horizontal direction, and can be provided to be arranged in the vertical direction as shown in FIG. 3C.

If the collector 5 is set to move in the prescribed direction, a continuous deposition operation is possible. Therefore, the production efficiency of the deposited body 110 made of the fiber 100 can be increased.

The deposited body 110 that is formed on the collector 5 is removed from the collector 5 by a worker. For example, the deposited body 110 is used in a nonwoven cloth, a filter, etc. The applications of the deposited body 110 are not limited to those illustrated.

Also, the collector 5 can be omitted. For example, the deposited body 110 that is made of the fiber 100 also can be directly formed on the surface of a member that is conductive. In such a case, it is sufficient for the member that is conductive to be grounded or for a voltage of the reverse polarity of the voltage applied to the nozzle 20 to be applied to the member that is conductive. Also, it is sufficient for the member that is conductive to be moved in the prescribed direction by using a conveyor, an industrial robot, etc. For example, the configuration of the member that is conductive is not particularly limited and may be a sheet configuration, may be a block configuration, or may be any configuration.

The member that is conductive may be fed in one direction, may be moved back and forth, or may be fed to circulate.

Also, the collector 5 or the member may not move.

The controller 6 controls the operations of the supplier 32, the source material liquid controller 33, the power supply 4, and the collector 5. The controller 6 can be, for example, a computer including a CPU (Central Processing Unit), memory, etc.

Here, in the case where the fibers 100 that are charged with the same polarity are deposited on the first surface 5*a* and the second surface 5*b* of the collector 5, there are cases where the fiber 100 deposited on the first surface 5*a* and the fiber 100 deposited on the second surface 5*b* repel each other at the vicinity of the end portion of the collector 5.

Figure 4:
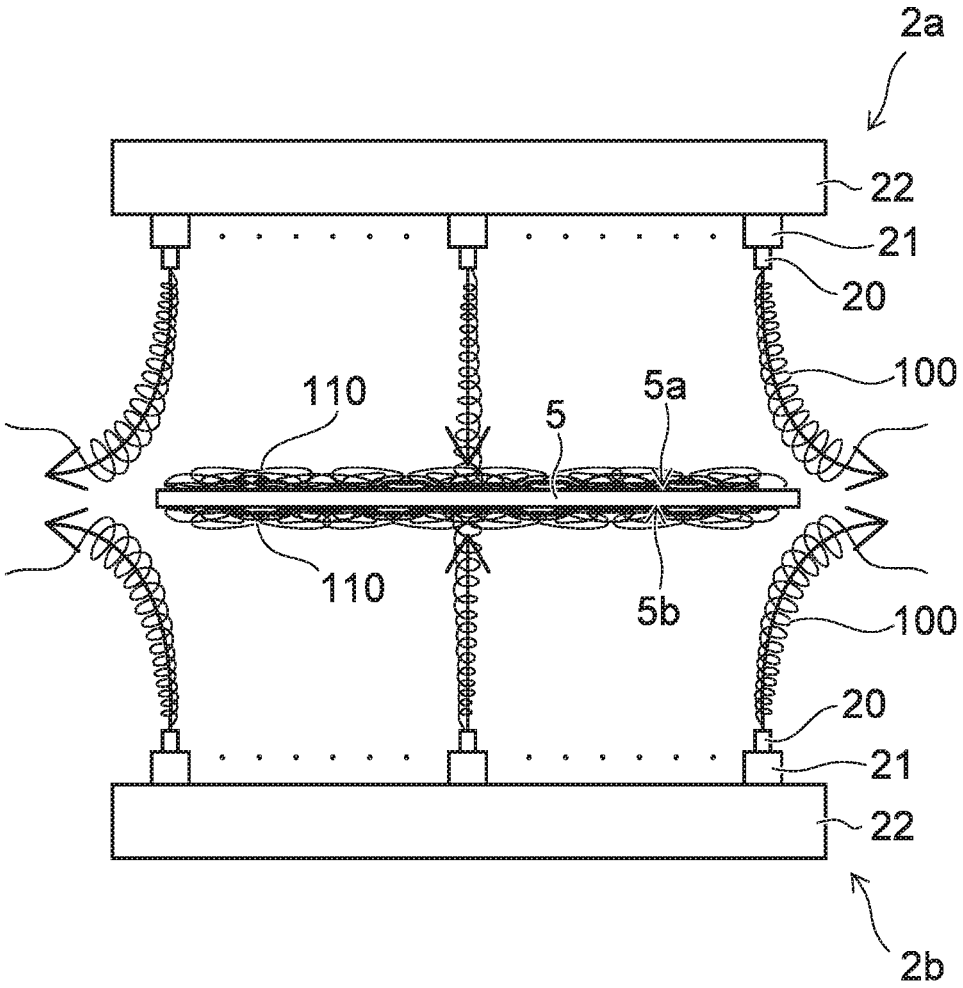
FIG. 4 is a schematic view for illustrating the repulsion between fibers at the vicinity of end portions of the collector.

FIG. 4 is a schematic view for illustrating the repulsion between the fibers 100 at the vicinity of the end portions of the collector 5.

As shown in FIG. 4, in the case where the repulsion between the fibers 100 occurs at the vicinity of the end portions of the collector 5, it becomes difficult to deposit the fibers 100 at the vicinity of the end portions of the collector 5. Therefore, there is a risk that the thickness at the vicinity of the end portion of the deposited body 110 may become thin; and the width dimension of the deposited body 110 may fluctuate. Also, there is a risk that the utilization efficiency of the source material liquid may decrease; and soiling may occur due to the fibers 100 adhered to the interior of the electrospinning apparatus 1.

Figure 5:
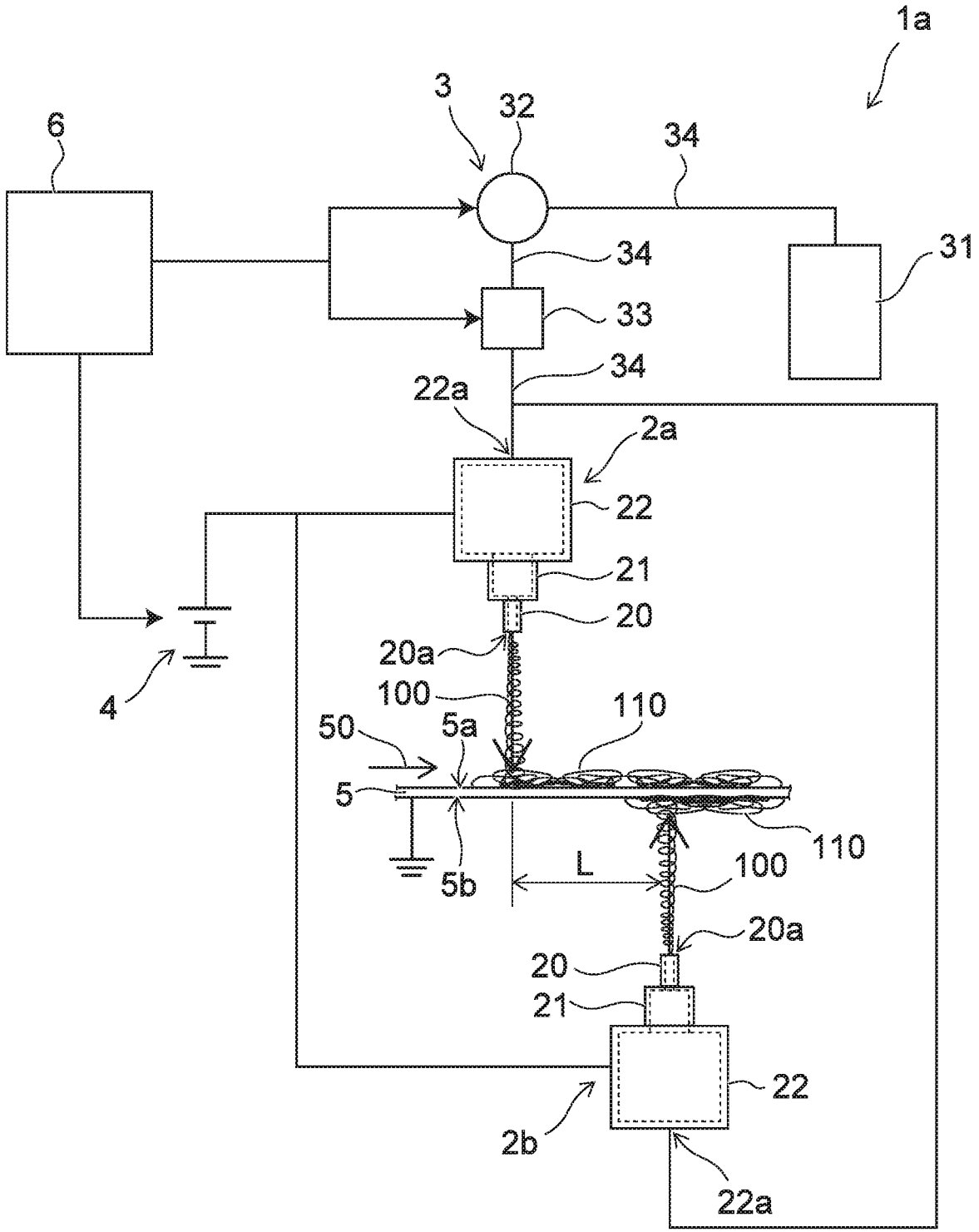
FIG. 5 is a schematic view for illustrating an electrospinning apparatus according to a second embodiment.

FIG. 5 is a schematic view for illustrating an electrospinning apparatus 1*a* according to a second embodiment.

In the electrospinning apparatus 1 described above, the second nozzle head 2*b* opposes the first nozzle head 2*a* with the collector 5 interposed. In other words, when viewed in plan, the second nozzle head 2*b* is provided at a position overlapping the first nozzle head 2*a*.

Conversely, in the electrospinning apparatus 1*a* according to the embodiment, the second nozzle head 2*b* is provided at a position that is separated from the first nozzle head 2*a* in the movement direction 50 of the collector 5. For example, the second nozzle head 2*b* is provided at a position that is shifted in the movement direction 50 of the collector 5 from the position where the first nozzle head 2*a* is provided. In other words, when viewed in plan, the second nozzle head 2*b* does not overlap the first nozzle head 2*a*. In such a case, a distance L between the first nozzle head 2*a* and the second nozzle head 2*b* can be set to be longer than the longer dimension of the dimension of the deposition region on the first surface 5*a* of the fiber 100 discharged from the first nozzle head 2*a* or the dimension of the deposition region on the second surface 5*b* of the fiber 100 discharged from the second nozzle head 2*b*. Thus, the repulsion between the fiber 100 deposited on the first surface 5*a* and the fiber 100 deposited on the second surface 5*b* at the vicinity of the end portions of the collector 5 can be suppressed. Therefore, the deposited body 110 can be formed on the entire region of the first surface 5*a* and the second surface 5*b*. Also, the fluctuation of the thickness and/or the width dimension of the deposited body 110 can be suppressed. Also, the utilization efficiency of the source material liquid can be increased; and the occurrence of the soiling due to the fibers 100 adhering to the interior of the electrospinning apparatus 1*a* can be suppressed.

When viewed in plan, the distance L is the distance between the first nozzle head 2*a* and the second nozzle head 2*b*.

Figure 6A:
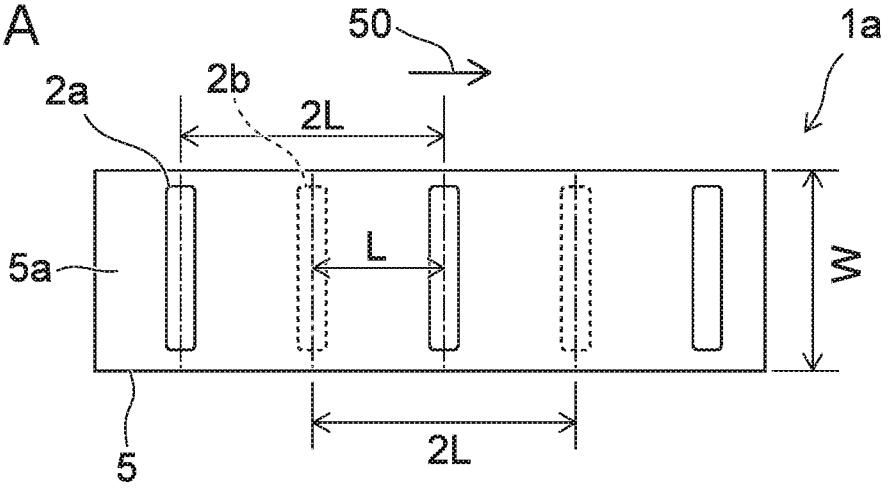
FIGS. 6A to 6C are schematic plan views for illustrating arrangement forms of a first nozzle head and a second nozzle head of the electrospinning apparatus.
Figure 6B:
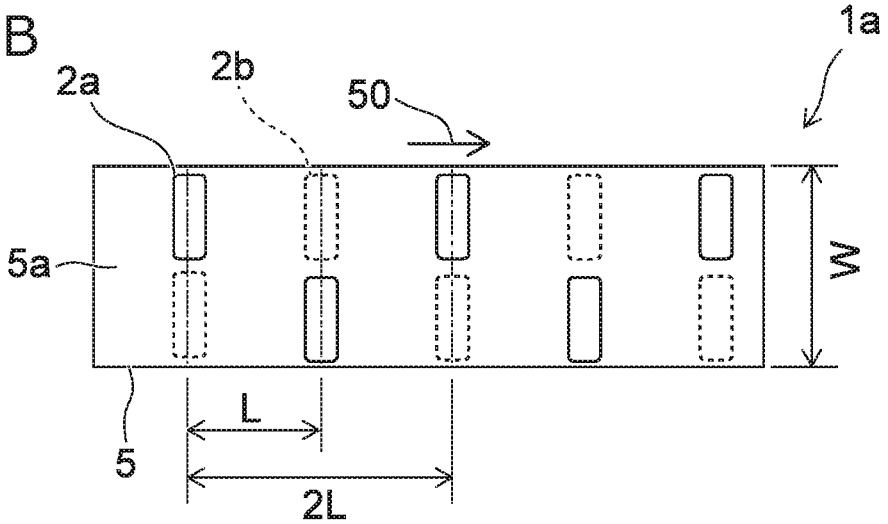
Figure 6C:
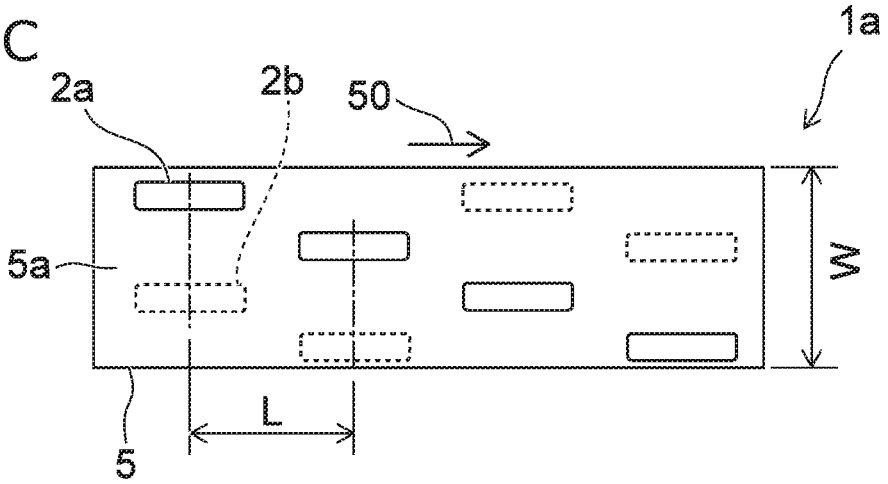

FIGS. 6A to 6C are schematic plan views for illustrating arrangement forms of the first nozzle head 2*a* and the second nozzle head 2*b* of the electrospinning apparatus 1*a*.

As shown in FIG. 6A, the multiple first nozzle heads 2*a* can be provided to be arranged in the movement direction 50 of the collector 5. The multiple second nozzle heads 2*b* can be provided to be arranged in the movement direction 50 of the collector 5. In such a case, the multiple first nozzle heads 2*a* can be arranged at a pitch dimension of 2L; and the multiple second nozzle heads 2*b* can be arranged at a pitch dimension of 2L. Then, when viewed in plan, the distance between the first nozzle head 2*a* and the second nozzle head 2*b* can be set to be L. Thus, the dimension of the electrospinning apparatus 1*a* in the movement direction 50 of the collector 5 can be shortened, that is, better space conservation of the electrospinning apparatus 1*a* can be realized.

Also, in the case where a width dimension W (a dimension in a direction orthogonal to the movement direction 50) of the collector 5 is long, the multiple first nozzle heads 2*a* can be provided to be arranged in the width direction of the collector 5 as shown in FIG. 6B. The multiple second nozzle heads 2*b* can be provided to be arranged in the width direction of the collector 5.

In such a case, there is a risk that the fibers 100 deposited on the first surface 5*a* may repel each other in the region between the first nozzle heads 2*a* if the multiple first nozzle heads 2*a* are provided to be proximal in the width direction of the collector 5. There is a risk that the fibers 100 deposited on the second surface 5*b* may repel each other in the region between the second nozzle heads 2*b* if the multiple second nozzle heads 2*b* are provided to be proximal in the width direction of the collector 5.

Therefore, one of the first nozzle heads 2*a* is provided at a position separated from an adjacent other first nozzle head 2*a* in a direction orthogonal to the movement direction 50 of the collector 5. In other words, the adjacent other first nozzle head 2*a* is provided at a position shifted in the direction orthogonal to the movement direction 50 of the collector 5. One of the second nozzle heads 2*b* is provided at a position separated from an adjacent second nozzle head 2*b* in the direction orthogonal to the movement direction 50 of the collector 5. In other words, the adjacent second nozzle head 2*b* is provided at a position shifted in the direction orthogonal to the movement direction 50 of the collector 5.

For example, as shown in FIG. 6B, the multiple first nozzle heads 2*a* can be provided to be arranged in a staggered configuration in the movement direction 50 of the collector 5. The multiple second nozzle heads 2*b* can be provided to be arranged in a staggered configuration in the movement direction 50 of the collector 5.

Also, to suppress the repulsion between the fiber 100 deposited on the first surface 5*a* and the fiber 100 deposited on the second surface 5*b* at the vicinity of the end portions of the collector 5, the multiple second nozzle heads 2*b* can be provided to not overlap the multiple first nozzle heads 2*a* when viewed in plan.

Also, in the case where the width dimension W of the collector 5 is short as shown in FIG. 6C, the direction in which the first nozzle head 2*a* extends can be set to be parallel to the movement direction 50 of the collector 5. Also, the multiple first nozzle heads 2*a* can be provided to be arranged in the width direction of the collector 5. Also, to suppress the fibers 100 deposited on the first surface 5*a* repelling each other in the region between the first nozzle heads 2*a*, one of the first nozzle heads 2*a* is provided at a position separated from an adjacent other first nozzle head 2*a* in a direction orthogonal to the movement direction 50 of the collector 5. In other words, the adjacent other first nozzle head 2*a* is provided at a position shifted in the direction orthogonal to the movement direction 50 of the collector 5.

The direction in which the second nozzle head 2*b* extends can be set to be parallel to the movement direction 50 of the collector 5. Also, the multiple second nozzle heads 2*b* can be provided to be arranged in the width direction of the collector 5. Also, to suppress the fibers 100 deposited on the second surface 5*b* repelling each other in the region between the second nozzle heads 2*b*, one of the second nozzle heads 2*b* is provided at a position separated from an adjacent second nozzle head 2*b* in the direction orthogonal to the movement direction 50 of the collector 5. In other words, the adjacent second nozzle head 2*b* is provided at a position shifted in the direction orthogonal to the movement direction 50 of the collector 5.

Figure 7:
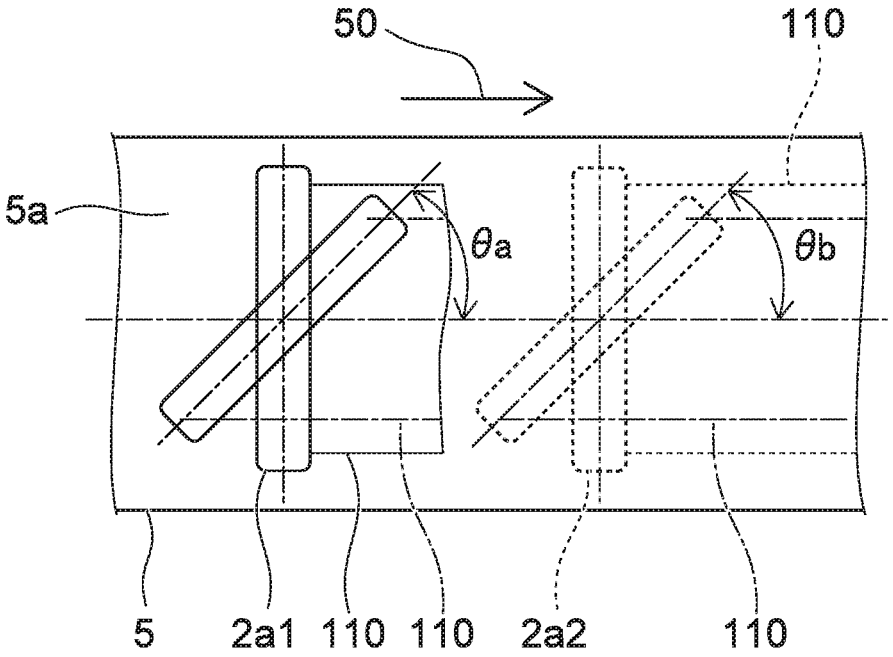
FIG. 7 is a schematic plan view for illustrating the first nozzle head and the second nozzle head according to another embodiment.

FIG. 7 is a schematic plan view for illustrating a first nozzle head 2*a*1 and a second nozzle head 2*b*1 according to another embodiment.

As shown in FIG. 7, an angle θa between the direction in which the first nozzle head 2*a*1 extends and the movement direction 50 of the collector 5 can be changed. In other words, the angle θa between the direction in which the first nozzle head 2*a* extends and the movement direction 50 of the collector 5 is changeable for the first nozzle head 2*a*.

An angle θb between the direction in which the second nozzle head 2*b*1 extends and the movement direction 50 of the collector 5 can be changed. In other words, the angle θb between the direction in which the second nozzle head 2*b* extends and the movement direction 50 of the collector 5 is changeable for the second nozzle head 2*b*.

For example, it is sufficient to provide one end portion of a shaft perpendicular to the first surface 5*a* of the collector 5 at the main part 22 of the first nozzle head 2*a* and to provide a holder that rotatably holds the shaft. It is sufficient to provide one end portion of a shaft perpendicular to the second surface 5*b* of the collector 5 at the main part 22 of the second nozzle head 2*b* and to provide a holder that rotatably holds the shaft.

Thus, by appropriately modifying the angle θa, the deposited bodies 110 that have different width dimensions in the first surface 5*a* can be formed easily. By appropriately modifying the angle θb, the deposited bodies 110 that have different width dimensions in the second surface 5*b* can be formed easily.

Also, collectors 5 that have different width dimensions W can be accommodated easily.

Effects of the electrospinning apparatuses 1 and 1*a* will now be described.

The source material liquid collects at the vicinity of the outlet 20*a* of the nozzle 20 due to surface tension.

The power supply 4 applies the voltage to the nozzle 20. Then, the source material liquid that is at the vicinity of the outlet 20*a* is charged with a prescribed polarity. In the case of the electrospinning apparatuses 1 and 1*a* illustrated in FIG. 1 and FIG. 5, the source material liquid that is at the vicinity of the outlet 20*a* is charged to be positive.

An electric field is generated between the nozzle 20 and the collector 5 because the collector 5 is grounded. Then, when the electrostatic force acting along the lines of electric force becomes larger than the surface tension, the source material liquid that is at the vicinity of the outlet 20*a* is drawn out toward the collector 5 by the electrostatic force. The source material liquid that is drawn out is elongated; and the fiber 100 is formed by the volatilization of the solvent included in the source material liquid. The fiber 100 that is formed is deposited on the first surface 5*a* and the second surface 5*b* of the collector 5 to form the deposited body 110 on the first surface 5*a* and the second surface 5*b*.

Also, in the case of the electrospinning apparatus 1*a*, the repulsion between the fiber 100 deposited on the first surface 5*a* and the fiber 100 deposited on the second surface 5*b* at the vicinity of the end portions of the collector 5 can be suppressed. Therefore, the deposited body 110 can be formed on the entire region of the first surface 5*a* and the second surface 5*b*. Also, the fluctuation of the thickness and/or the width dimension of the deposited body 110 can be suppressed. Also, the utilization efficiency of the source material liquid can be increased; and the occurrence of soiling due to the fiber 100 adhering to the interior of the electrospinning apparatus 1*a* can be suppressed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention. Moreover, above-mentioned embodiments can be combined mutually and can be carried out.

What is claimed is:

1. An electrospinning apparatus configured to deposit a fiber on a collector having a part that moves in a first direction or a member having a part that moves in a first direction, the electrospinning apparatus comprising:

a first nozzle head provided on one side of the part of the collector moving in the first direction or the part of the member moving in the first direction; and a second nozzle head provided on a side opposite to the first nozzle head with the part of the collector moving in the first direction or the part of the member moving in the first direction interposed, the second nozzle head being provided at a position separated from the first nozzle head in the first direction, such that when viewed in plan, the second nozzle head does not overlap the first nozzle head.

2. The electrospinning apparatus according to claim 1, further comprising: a controller is configured to control depositing of the fiber by the first nozzle head and depositing of the fiber by the second nozzle head, the controller causes the fiber to be deposited by the second nozzle head when causing the fiber to be deposited by the first nozzle head.

3. The electrospinning apparatus according to claim 1, wherein a plurality of the first nozzle heads is provided to be arranged in the first direction.

4. The electrospinning apparatus according to claim 3, wherein one of the first nozzle heads is provided at a position separated from an adjacent other of the first nozzle heads in a direction orthogonal to the first direction.

5. The electrospinning apparatus according to claim 3, wherein one of the first nozzle heads is provided on one end portion side of the collector or the member in a direction orthogonal to the first direction, and an adjacent other of the first nozzle heads is provided on another end portion side of the collector or the member in the first direction.

6. The electrospinning apparatus according to claim 1, wherein a plurality of the second nozzle heads is provided to be arranged in the first direction.

7. The electrospinning apparatus according to claim 6, wherein one of the second nozzle heads is provided at a position separated from an adjacent other of the second nozzle heads in a direction orthogonal to the first direction.

8. The electrospinning apparatus according to claim 6, wherein one of the second nozzle heads is provided on one end portion side of the collector or the member in a direction orthogonal to the first direction, and an adjacent other of the second nozzle heads is provided on another end portion side of the collector or the member in the first direction.

9. The electrospinning apparatus according to claim 1, wherein an angle is changeable for at least one of the first nozzle head or the second nozzle head, the angle being between an extension direction of the nozzle head and the first direction.

10. An electrospinning method of depositing a fiber on a collector having a part that moves in a first direction or a member having a part that moves in a first direction, the electrospinning method comprising causing the fiber to be deposited by a second nozzle head when causing the fiber to be deposited by a first nozzle head, the first nozzle head being provided on one side of the part of the collector moving in the first direction or the part of the member moving in the first direction, the second nozzle head being provided on a side opposite to the first nozzle head with the part of the collector moving in the first direction or the part of the member moving in the first direction interposed, and the second nozzle head being provided at a position separated from the first nozzle head in the first direction, such that when viewed in plan, the second nozzle head does not overlap the first nozzle head.

* * * * *